US010844314B2

(12) United States Patent
Morrison et al.

(10) Patent No.: US 10,844,314 B2
(45) **Date of Patent: *Nov. 24, 2020**

(54) LUBRICATION OF TRANSFER PLATES USING AN OIL OR OIL IN WATER EMULSIONS

(71) Applicant: Ecolab USA Inc., St. Paul, MN (US)

(72) Inventors: Eric D. Morrison, West St. Paul, MN (US); Chad A. Thompson, Farmington, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/436,017

(22) Filed: Jun. 10, 2019

(65) Prior Publication Data

US 2020/0002642 A1 Jan. 2, 2020

Related U.S. Application Data

(63) Continuation of application No. 15/845,617, filed on Dec. 18, 2017, now Pat. No. 10,316,267, which is a continuation of application No. 14/202,399, filed on Mar. 10, 2014, now Pat. No. 9,873,853.

(60) Provisional application No. 61/776,049, filed on Mar. 11, 2013.

(51) Int. Cl.

| | |
|---|---|
| ***C10M 173/00*** | (2006.01) |
| ***C10M 173/02*** | (2006.01) |
| *B65B 65/06* | (2006.01) |
| *C10N 40/00* | (2006.01) |
| *C10N 50/00* | (2006.01) |

(52) U.S. Cl.

CPC ..... *C10M 173/025* (2013.01); *C10M 173/00* (2013.01); *B65B 65/06* (2013.01); *C10M 2207/28* (2013.01); *C10M 2207/282* (2013.01); *C10M 2207/283* (2013.01); *C10M 2207/289* (2013.01); *C10M 2209/108* (2013.01); *C10N 2040/38* (2020.05); *C10N 2050/01* (2020.05); *C10N 2050/011* (2020.05); *Y10T 137/0318* (2015.04)

(58) Field of Classification Search

CPC . B65B 65/06; C10M 173/025; C10M 173/00; Y10T 137/0318

See application file for complete search history.

(56) References Cited

U.S. PATENT DOCUMENTS

| | | | |
|---|---|---|---|
| 3,011,975 | A | 12/1961 | Nitzsche |
| 3,213,024 | A | 10/1965 | Blake |
| 3,514,314 | A | 5/1970 | Nemeth |
| 3,664,956 | A | 5/1972 | Messina |

(Continued)

FOREIGN PATENT DOCUMENTS

| | | |
|---|---|---|
| CA | 1157456 | 11/1983 |
| DE | 19942535 | 3/2001 |

(Continued)

OTHER PUBLICATIONS

US 5,863,871 A, 01/1999, Besse (withdrawn)

(Continued)

*Primary Examiner* — Ellen M McAvoy

(74) *Attorney, Agent, or Firm* — Merchant & Gould P.C.

(57) ABSTRACT

This disclosure relates to transfer plate lubricant compositions and methods of transporting open containers across stationary transfer plates.

16 Claims, 1 Drawing Sheet

(56) References Cited

U.S. PATENT DOCUMENTS 3,853,607 A 12/1974 Iyengar
3,981,812 A 9/1976 Zeitz
4,062,785 A 12/1977 Nibert
4,065,590 A 12/1977 Salensky
4,069,933 A 1/1978 Newing
4,083,791 A 4/1978 Elliott
4,105,716 A 8/1978 Sakai
4,132,657 A 1/1979 Verdicchio
4,149,624 A 4/1979 Douty
4,162,347 A 7/1979 Montgomery
4,165,291 A 8/1979 Gragson
4,197,937 A 4/1980 Sanford et al.
4,225,450 A 9/1980 Rosenberger
4,248,724 A 2/1981 Macintosh
4,252,528 A 2/1981 Decker
4,260,499 A 4/1981 Fein et al.
4,262,776 A 4/1981 Wilson
4,264,650 A 4/1981 Schulze
4,274,973 A 6/1981 Stanton
4,289,671 A 9/1981 Hernandez
4,324,671 A 4/1982 Christian
4,343,616 A 8/1982 Decker
4,375,444 A 3/1983 Deeken
4,420,578 A 12/1983 Hagens
4,436,200 A 3/1984 Hodlewski
4,478,889 A 10/1984 Maruhashi
4,486,378 A 12/1984 Hirata
4,515,836 A 5/1985 Cobbs, Jr.
4,525,377 A 6/1985 Nickel
4,534,995 A 8/1985 Pocock
4,537,285 A 8/1985 Brown et al.
4,538,542 A 9/1985 Kennon
4,543,909 A 10/1985 Sharpless
4,555,543 A 11/1985 Effenberger
4,569,869 A 2/1986 Kushida et al.
4,573,429 A 3/1986 Cobbs, Jr. et al.
4,604,220 A 8/1986 Stanton
4,632,053 A 12/1986 Villaueva et al.
4,690,299 A 9/1987 Cannon
4,699,809 A 10/1987 Maruhashi et al.
4,713,266 A 12/1987 Hasegawa et al.
4,714,580 A 12/1987 Maruhashi et al.
4,719,022 A 1/1988 Hyde
4,769,162 A 9/1988 Remus
4,828,727 A 5/1989 Mcaninch
4,851,287 A 7/1989 Hartsing, Jr.
4,855,162 A 8/1989 Wrasidlo
4,867,890 A 9/1989 Colclough
4,874,647 A 10/1989 Yatsu
4,877,111 A 10/1989 Kilper
4,919,984 A 4/1990 Maruhashi
4,929,375 A 5/1990 Rossio
4,980,211 A 12/1990 Kushida
4,995,993 A 2/1991 Papke
5,001,935 A 3/1991 Tekkanat
5,009,801 A 4/1991 Wider
5,032,301 A 7/1991 Pawloski
5,073,280 A 12/1991 Rossio
5,104,559 A 4/1992 Pawloski
5,115,047 A 5/1992 Hashimoto
5,145,721 A 9/1992 Kojima
5,160,646 A 11/1992 Scheld
5,174,914 A 12/1992 Gutzmann
5,182,035 A 1/1993 Schmidt
5,202,037 A 4/1993 Lavelle
5,209,860 A 5/1993 Trivett
5,238,718 A 8/1993 Yano
5,244,589 A 9/1993 Liu
5,317,061 A 5/1994 Chu
5,334,322 A 8/1994 Williams, Jr.
RE34,742 E 9/1994 Maier
5,352,376 A 10/1994 Gutzmann
5,371,112 A 12/1994 Sayre
5,391,308 A 2/1995 Despo
5,411,672 A 5/1995 Kagaya
5,441,654 A 8/1995 Rossio
5,474,692 A 12/1995 Laufenberg et al.
5,509,965 A 4/1996 Harry
5,510,045 A 4/1996 Remus
5,559,087 A 9/1996 Halsrud
5,565,127 A 10/1996 Laufenberg
5,573,819 A 11/1996 Nugent, Jr.
5,584,201 A 12/1996 Graham et al.
5,652,034 A 7/1997 Seiner
5,658,619 A 8/1997 Kirschner
5,663,131 A 9/1997 Winicov
5,670,463 A 9/1997 Maples
5,672,401 A 9/1997 Anglin
5,681,628 A 10/1997 Niederst
5,698,269 A 12/1997 Carlblom
5,721,023 A 2/1998 Ostapchenko
5,723,418 A 3/1998 Person Hei
5,728,770 A 3/1998 Yamamoto
5,747,431 A 5/1998 Taylour
5,758,761 A 6/1998 Selbertinger et al.
5,783,303 A 7/1998 Tsuei
5,789,459 A 8/1998 Inagaki
5,863,874 A 1/1999 Person Hei
5,871,590 A 2/1999 Hei
5,876,812 A 3/1999 Frisk
5,925,601 A 7/1999 Mcsheny
5,932,526 A 8/1999 Person Hei
5,935,914 A 8/1999 Theyssen
5,952,601 A 9/1999 Sanford
6,060,444 A 5/2000 Schulz
6,087,308 A 7/2000 Butler
6,096,692 A 8/2000 Hagihara
6,207,622 B1 3/2001 Li
6,214,777 B1 4/2001 Li et al.
6,288,012 B1 9/2001 Li
6,372,698 B1 4/2002 Strothoff et al.
6,427,826 B1 8/2002 Li
6,495,494 B1 12/2002 Li
6,509,302 B2 1/2003 Li
6,541,430 B1 4/2003 Beatty
6,569,816 B2 5/2003 Oohira
6,576,298 B2 6/2003 Bennett
6,653,263 B1 11/2003 Küpper
6,673,753 B2 1/2004 Person Hei
6,677,280 B2 1/2004 Küpper
6,688,434 B2 2/2004 Johnson et al.
6,696,394 B1 2/2004 Ruhr
6,743,758 B2 6/2004 Li
6,780,823 B2 8/2004 Li
6,806,240 B1 10/2004 Hei
6,809,068 B1 10/2004 Küpper
6,821,568 B2 11/2004 Bennett et al.
6,855,676 B2 2/2005 Li et al.
6,933,263 B2 8/2005 Manka
6,962,897 B2 11/2005 Küpper et al.
6,967,189 B2 11/2005 Li et al.
7,109,152 B1 9/2006 Corby et al.
7,125,827 B2 10/2006 Li et al.
7,297,666 B2 11/2007 Küpper et al.
7,384,895 B2 6/2008 Person Hei et al.
7,462,584 B2 12/2008 Küpper et al.
7,524,797 B1 4/2009 Perez, Jr. et al.
7,651,984 B2 1/2010 Cook et al.
7,727,941 B2 6/2010 Morrison et al.
7,741,255 B2 6/2010 Morrison et al.
7,741,257 B2 6/2010 Valencia Sil et al.
7,745,381 B2 6/2010 Valencia Sil et al.
7,915,206 B2 3/2011 Morrison et al.
8,716,200 B2 5/2014 Seemeyer
9,873,853 B2 * 1/2018 Morrison ..... C10M 173/025
10,316,267 B2 * 6/2019 Morrison ..... C10M 173/025
2002/0025912 A1 2/2002 Person Hei
2003/0073589 A1 4/2003 Li
2003/0207040 A1 11/2003 Bennett et al.
2004/0029741 A1 2/2004 Corby et al.
2004/0053791 A1 3/2004 Langer et al.
2004/0058829 A1 3/2004 Hei
2004/0097382 A1 5/2004 Li
2004/0102337 A1 5/2004 Li

(56) References Cited

U.S. PATENT DOCUMENTS

| | | | |
|---|---|---|---|
| 2004/0235680 | A1 | 11/2004 | Lawrence |
| 2005/0059564 | A1 | 3/2005 | Li et al. |
| 2005/0070448 | A1 | 3/2005 | Kupper et al. |
| 2006/0211584 | A1 | 9/2006 | Court et al. |
| 2007/0066496 | A1 | 3/2007 | Morrison et al. |
| 2007/0066497 | A1 | 3/2007 | Morrison et al. |
| 2007/0298981 | A1 | 12/2007 | Morrison et al. |
| 2008/0108532 | A1 | 5/2008 | Kuepper et al. |
| 2008/0176778 | A1 | 7/2008 | Seemeyer et al. |
| 2009/0017243 | A1 | 1/2009 | Person Hei et al. |
| 2009/0192061 | A1 | 7/2009 | Boegner et al. |
| 2009/0253598 | A1 | 10/2009 | Theyssen et al. |
| 2011/0269653 | A1 | 11/2011 | Praeckel |
| 2012/0073907 | A1 | 3/2012 | Seemeyer et al. |
| 2012/0241289 | A1 | 9/2012 | Valencia Sil et al. |

FOREIGN PATENT DOCUMENTS

| | | | |
|---|---|---|---|
| DE | 10 2006 038 311 | A1 | 2/2008 |
| EP | 0359330 | | 3/1990 |
| EP | 0 684 981 | B1 | 3/1997 |
| EP | 0844299 | | 5/1998 |
| EP | 0 767 825 | B1 | 9/1998 |
| EP | 0 670 675 | B1 | 3/1999 |
| EP | 1 001 005 | A1 | 5/2000 |
| EP | 0 883 668 | B1 | 10/2001 |
| EP | 1 308 393 | B1 | 2/2005 |
| EP | 1 474 501 | B1 | 7/2006 |
| EP | 0 797 652 | B1 | 8/2006 |
| EP | 1 690 920 | A1 | 8/2006 |
| EP | 1 214 387 | B1 | 7/2007 |
| EP | 1 204 730 | B1 | 8/2007 |
| EP | 1 840 196 | A1 | 10/2007 |
| EP | 1 842 898 | A1 | 10/2007 |
| EP | 1 932 901 | A1 | 6/2008 |
| EP | 1 334 914 | B1 | 10/2008 |
| EP | 2 105 493 | A1 | 9/2009 |
| EP | 2 105 494 | A1 | 9/2009 |
| GB | 1564128 | | 4/1980 |
| JP | 57003892 | | 1/1982 |
| JP | S58125513 | | 7/1983 |
| JP | 62-129388 | | 6/1987 |
| JP | 6136377 | | 5/1994 |
| JP | 7247293 | | 9/1995 |
| JP | 7268380 | | 10/1995 |
| JP | 10053679 | | 2/1998 |
| JP | 10059523 | | 3/1998 |
| JP | 10-511139 | | 10/1998 |
| JP | 2001517938 | | 10/2001 |
| JP | 2002-275483 | | 9/2002 |
| JP | 2003181388 | | 7/2003 |
| JP | 2004508173 | | 3/2004 |
| JP | 2004508253 | | 3/2004 |
| JP | 2004518013 | | 6/2004 |
| JP | 2004217866 | | 8/2004 |
| JP | 2009526121 | | 7/2009 |
| JP | 2010503747 | | 2/2010 |
| NL | 9300742 | | 12/1993 |
| WO | WO 92/13048 | | 8/1992 |
| WO | WO 94/01517 | | 1/1994 |
| WO | WO96/08601 | | 3/1996 |
| WO | WO97/45508 | A1 | 12/1997 |
| WO | WO98/51746 | | 11/1998 |
| WO | WO 98/59023 | | 12/1998 |
| WO | WO01/07544 | A1 | 2/2001 |
| WO | WO01/07554 | | 2/2001 |
| WO | WO01/12759 | | 2/2001 |
| WO | WO02/20381 | | 3/2002 |
| WO | WO03035268 | | 5/2003 |
| WO | WO03078557 | | 9/2003 |
| WO | WO 2005/014764 | A1 | 2/2005 |
| WO | WO2006/009421 | | 1/2006 |
| WO | WO2006/017503 | | 2/2006 |
| WO | WO 2006/088658 | A1 | 8/2006 |
| WO | WO 2006/101609 | A1 | 9/2006 |
| WO | WO 2007/040677 | A1 | 4/2007 |
| WO | WO 2007/040678 | A1 | 4/2007 |
| WO | WO 2007/090018 | A1 | 8/2007 |
| WO | WO2007/094980 | A2 | 8/2007 |
| WO | WO 2007/112917 | A2 | 10/2007 |
| WO | WO 2007/149175 | A2 | 12/2007 |
| WO | WO2008/032284 | A2 | 3/2008 |
| WO | WO2008/032284 | A3 | 3/2008 |
| WO | WO 2008/073951 | A1 | 6/2008 |
| WO | WO 2009/120751 | A2 | 10/2009 |
| WO | WO 2009/120768 | A1 | 10/2009 |

OTHER PUBLICATIONS

U.S. Appl. No. 60/149,095, filed Aug. 16, 1999, Hei.
U.S. Appl. No. 60/149,048, filed Aug. 16, 1999, Hei.
U.S. Appl. No. 09/619,261, filed Jul. 19, 2000, Corby.
U.S. Appl. No. 60/230,662, filed Sep. 7, 2000, Bennett.
U.S. Appl. No. 11/080,000, filed Mar. 15, 2005, Valencia Sil.
U.S. Appl. No. 11/233,596, filed Sep. 22, 2005, Morrison.
U.S. Appl. No. 11/351,863, filed Feb. 10, 2006, Valencia Sil.
European Search Report of EP03076177 dated Jul. 17, 2003, 2 pgs.
International Search Report of EP03076178 dated Jun. 12, 2003, 2 pgs.
Dow Corning "Emulsion" [Online], 1998, XP002463027, URL: http://www.2.dowcorning.com/DataFiles/090007c880001bdc.pdf, Dec. 19, 2007, 2 pgs.
DUPONT, "Krytox® Dry Film Lubricants", Nov. 1997, 6 pgs.
Ecolab, "Lube Application to Conveyor Surface/Containers", Jun. 13, 2000, 7 pgs.
Gangal, S., "Polytetrafluoroethylene", Encyclopedia of Chemical Technology, (Jun. 27, 1994), 4$^{th}$ Ed., vol. 11, pp. 621-644, 25 pgs.
Gilbert, Peter, "Conveyor Lubrication in Dairies, Breweries and Beverage Plants", Klensan (Pty) Ltd., S.A. Food Review—Dec. 1981/Jan. 1982, pp. 27-28, 2 pages.
Gorton, Hugh J., Ph.D. and Taylour, Jim M. Ph.D. C Chem, "The Development of New Conveyor Lubricant Technology", MBAA Technical Quarterly, vol. 30, pp. 18-22, 1993, 5 pages.
Henkel Ecolab, "Conveyor Lubrication", 27 Food Ireland, 1 page.
Interflon, "FIN Food Lube AL. High Penetration Teflon® Lubricating Agent Especially Suitable for Automatic Lubrication Systems for the Food Processing Industry", 1998, 20 pgs.
Interflon, Maintenance Products with Teflon®, http://www.interflon.nl/engels.htm, Jun. 18, 1999, 10 pgs.
Moskala, E., "Environmental Stress Cracking in PET Beverage Containers", BEV-PAK Americas '96, Apr. 15-16, 1996, 14 pgs.
Moskala, E., "Environmental Stress Cracking in PET Carbonated Soft Drink Containers", Bev Tech 98, Mar. 30-Apr. 1, 1998, 22 pgs.
Hygiene "Maintaining hygiene on filler line conveyor track", 2 pages.
Synco Chemical Corporation, "Other Super Lube Products . . . What is Super Lube®?" http://www.super-lube.com, May 5, 1999, 5 pgs.
Tekkanat, B. et al., "Environmental Stress Cracking Resistance of Blow Molded Poly(Ethylene Terephthalate) Containers", Polymer Engineering and Science, vol. 32, No. 6, Mar. 1992, pp. 393-397, 5 pgs.
Report on the Filing or Determination of an Action Regarding a Patent or Trademark with attached Compalint from the Middle District of Florida, Case 6:10-cv-01208-ACC-GJK, Aug. 13, 2010, 17 pages.
6:10-cv-01208-ACC-GJK, *Ecolab* v. *ICC, USDC*, Middle Dist. of FL: Docket Sheet, 2 pages, printed Feb. 13, 2012.
6:10-cv-01208-ACC-GJK, *Ecolab* v. *ICC, USDC*, Middle Dist. of FL: Civil Cover Sheet, 1 page, Aug. 13, 2010.
6:10-cv-01208-ACC-GJK, *Ecolab* v. *ICC, USDC*, Middle Dist. of FL: Complaint with Exhibits A-K, 58 pages, Aug. 13, 2010.
6:10-cv-01208-ACC-GJK, *Ecolab* v. *ICC, USDC*, Middle Dist. of FL: Patent/Trademark Report, 1 page, Aug. 13, 2010.
6:10-cv-01208-ACC-GJK, *Ecolab* v. *ICC, USDC*, Middle Dist. of FL: Related case/Interested persons/ECF-2, 8 pages, Aug. 30, 2010.
6:10-cv-01208-ACC-GJK, *Ecolab* v. *ICC, USDC*, Middle Dist. of FL: Notice of Pendency of Related Cases, 2 pages, Sep. 15, 2010.

(56) References Cited

OTHER PUBLICATIONS

6:10-cv-01208-ACC-GJK, *Ecolab* v. *ICC, USDC*, Middle Dist. of FL: Certificate of Interested Persons and Corporate Disclosure Statement, 12 pages, Sep. 15, 2010.
6:10-cv-01208-ACC-GJK, *Ecolab* v. *ICC, USDC*, Middle Dist. of FL: Defendant's Motion to Dismiss, 8 pages, Feb. 14, 2011.
6:10-cv-01208-ACC-GJK, *Ecolab* v. *ICC, USDC*, Middle Dist. of FL: Amended Complaint with Exhibits A-L, 66 pages, Feb. 18, 2011.
6:10-cv-01208-ACC-GJK, *Ecolab* v. *ICC, USDC*, Middle Dist. of FL: Motion to Dismiss, 25 pages, Mar. 4, 2011.
6:10-cv-01208-ACC-GJK, *Ecolab* v. *ICC, USDC*, Middle Dist. of FL: Response to Motion, 21 pages, Mar. 18, 2011.
6:10-cv-01208-ACC-GJK, *Ecolab* v. *ICC, USDC*, Middle Dist. of FL: Defendant's Brief, 4 pages, Apr. 19, 2011.
6:10-cv-01208-ACC-GJK, *Ecolab* v. *ICC, USDC*, Middle Dist. of FL: Order on Motion to Dismiss, 7 pages, Sep. 27, 2011.
6:10-cv-01208-ACC-GJK, *Ecolab* v. *ICC, USDC*, Middle Dist. of FL: Motion for Reconsideration, 4 pages, Oct. 6, 2011.
6:10-cv-01208-ACC-GJK, *Ecolab* v. *ICC, USDC*, Middle Dist. of FL: Answer to Complaint, 13 pages, Oct. 11, 2011.
6:10-cv-01208-ACC-GJK, *Ecolab* v. *ICC, USDC*, Middle Dist. of FL: Response in Opposition to Motion, 6 pages, Oct. 24, 2011.
6:10-cv-01208-ACC-GJK, *Ecolab* v. *ICC, USDC*, Middle Dist. of FL: Order on Motion for Reconsideration, 4 pages, Nov. 1, 2011.
6:10-cv-01208-ACC-GJK, *Ecolab* v. *ICC, USDC*, Middle Dist. of FL: Answer to Amended Complaint, 38 pages, Nov. 8, 2011.
6:10-cv-01208-ACC-GJK, *Ecolab* v. *ICC, USDC*, Middle Dist. of FL: Motion to Dismiss, 20 pages, Dec. 2, 2011.
6:10-cv-01208-ACC-GJK, *Ecolab* v. *ICC, USDC*, Middle Dist. of FL: Second Amended Complaint with Exhibits A-M, 77 pages, Dec. 8, 2011.
6:10-cv-01208-ACC-GJK, *Ecolab* v. *ICC, USDC*, Middle Dist. of FL: Answer to Second Amended Complaint, 37 pages, Dec. 29, 2011.
6:10-cv-01208-ACC-GJK, *Ecolab* v. *ICC, USDC*, Middle Dist. of FL: Motion to Dismiss, 21 pages, Jan. 11, 2012.
6:10-cv-01208-ACC-GJK, *Ecolab* v. *ICC, USDC*, Middle Dist. of FL: Answer to Second Amended Complaint, 45 pages, Jan. 25, 2012.
6:10-cv-01208-ACC-GJK, *Ecolab* v. *ICC, USDC*, Middle Dist. of FL: Motion to Seal Document, 23 pages, Jan. 26, 2012.
Lubranol DWS Hybrid Lube Innovative Track Treatment, Sopura, 2 pages (Date Unknown).
Stachura, P. et al., "Conveyor Lubrication in a Sustainable World," Sopura, 14 pages (Date Unknown).
International Search Report and Written Opinion dated Jun. 26, 2012.
European Search Report for Application No. 14779527.2 dated Jul. 29, 2016.
International Search Report and Written Opinion for PCT/US2014/022504 dated Jun. 20, 2014.
International Search Report (PCT/US2007/002954), dated Feb. 10, 2007.
European Search Report, PCT/IB2011054184, dated Apr. 1, 2015.

* cited by examiner

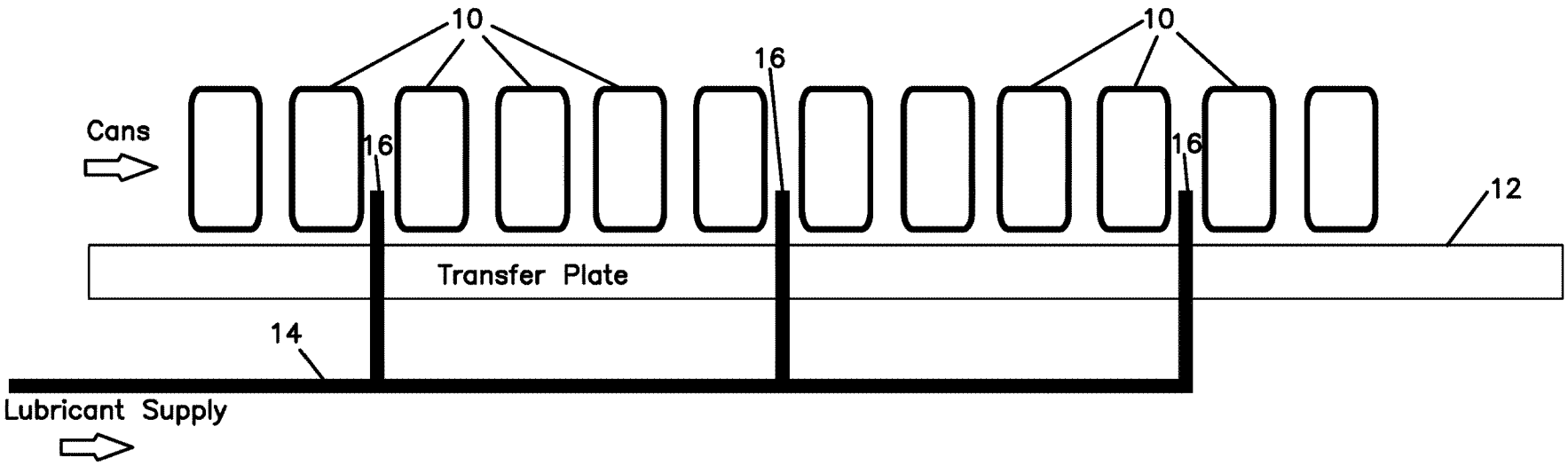
Cans
10
10
16
16
16
Transfer Plate
12
14
Lubricant Supply

LUBRICATION OF TRANSFER PLATES USING AN OIL OR OIL IN WATER EMULSIONS

CROSS REFERENCE TO RELATED APPLICATIONS

This application is a continuation of U.S. application Ser. No. 15/845,617, filed Dec. 18, 2017, now U.S. Pat. No. 10,316,267, issued Jun. 11, 2019, which is a continuation of U.S. application Ser. No. 14/202,399, filed Mar. 10, 2014, now U.S. Pat. No. 9,873,853, issued Jan. 23, 2018, which claims the benefit of U.S. Provisional Application Ser. No. 61/776,049, filed Mar. 11, 2013, entitled "Lubrication of Transfer Plates Using Oil in Water Emulsions," which are incorporated by reference herein in their entirety.

FIELD

This disclosure relates to transfer plate lubricants and to a method for transporting unclosed containers filled with liquid product on a stationary member from a filler to a device which applies a closure to the container.

BACKGROUND

During most transport steps in commercial container filling or packaging operations, the container is closed and rests upon a moving conveyor belt or chain. One exception is the transfer plate where open containers are moved from where they are filled to where they are closed over a stationary plate. This transfer plate is challenging because the containers are open and prone to spilling their contents. If they spill too much, they will be rejected upon inspection. Further, if the package is not aligned properly going into the closer, the closure could be poor or the entire machine could jam. These concerns are complicated by the fact that the open containers move very quickly. It is against this background that the present disclosure has been made.

SUMMARY

Surprisingly, it has been discovered that transfer plates can be lubricated using a substantially aqueous lubricant composition that comprises an oil or an oil in water emulsion. In particular, it has been found that the presence of dispersed water-insoluble compounds greatly reduces the amount of surfactant normally required for adequate lubrication of transfer plates. It is further surprising that the total concentration of oil plus emulsifying surfactant taken together can be substantially less than the concentration of surfactant required in conventional container transfer lubrication which lacks a water-insoluble oil.

The present disclosure provides, in one aspect, a method for lubricating the passage of an open container along a container transfer plate comprising providing a lubricating liquid layer which comprises an aqueous dispersion of oil.

BRIEF DESCRIPTION OF THE DRAWINGS

FIG. 1 shows a schematic of a can transfer plate.

DETAILED DESCRIPTION

In commercial container filling or packaging operations, containers such as beverage containers are filled and transported from the point of filling to other stations on the filling line for subsequent processing steps such as closing, rinsing, warming or cooling, labeling, and packing. During most transport steps the container is closed and the container moves along with the conveyor surface. When containers are transported by a moving conveyor belt or chain, a conveyor lubricant may be used to reduce the coefficient of friction between the container and conveyor surface thereby facilitating differences in translational speed (i.e. slip) between the container and the conveyor that result from acceleration of the container (including increases or decreases in velocity or changes in direction) or that result from stoppage of containers situated on conveyors moving underneath. Generally, containers transported by moving conveyor belts or chains are closed and the relative motion of containers versus the moving conveyor belt is relatively low (less than about 40 feet per minute relative motion) or even close to zero. In the case of transport on moving conveyor belts or chains, accelerations of the container such as speeding up, slowing down, or changing direction result directly from traction between the container and conveyor belt. In this case, the lubricant controls the coefficient of friction without reducing it to a minimum amount, otherwise containers simply will not move or will move unacceptably backwards or transversely under the influence of gravity or contact with other containers or equipment. Exemplary lubricants include wet and dry lubricants.

One of the more difficult steps in transporting containers occurs when filled unclosed containers are moved from where they were filled to where they are closed. In the case of transporting open beverage containers, product spillage must be minimized so that the proper liquid volume is provided for sale. Furthermore, the transported open containers must move smoothly without excessive wobbling or transverse motion because misalignment of the open container at the point of interaction with the closing device will result in machine jamming and damage. Because the open containers in transit from the filler to the closing device are moving in single file, the forward translational velocity can reach speeds of 250 feet per minute, or even 610 feet per minute or more or roughly 2200 cans per minute. Because containers are moving on a stationary plate, the requirement for lubrication is especially demanding and it is important to achieve and maintain the minimum possible coefficient of friction.

Because of the very high relative motion of the container to the stationary plate and the requirement for very low coefficient of friction, methods for lubricating stationary transfer plates between fillers and closing devices are different from methods used for lubricating moving conveyor belts. In particular, lubrication of transfer plates is provided by maintaining the plate surface flooded with an aqueous lubricant composition. By flooded it is meant that the plate is substantially immersed by a puddle of aqueous lubricant composition with a coverage of about 0.05 to about 0.2 $mL/cm^2$ (about 0.5 to 2 mm depth). Continuous flooding of the plate may be accomplished by pumping lubricant composition upwards from holes in the center of the transfer plate. This is shown in FIG. 1 which generally shows cans 10 moving across a transfer plate 12. A lubricant source (not shown) is connected to a lubricant supply line 14. The lubricant supply line 14 is in fluid communication with one or more nozzles or bubblers 16 on the bottom of the transfer plate 12. During operation, lubricant flows from the lubricant source, through the lubricant supply line 14 to the one or more nozzles or bubblers 16 and out the bottom of the transfer plate 12 to provide lubrication to the cans 10 moving across the stationary transfer plate 12. The nozzles or bubblers may be flush with the transfer plate so that the cans can pass over them, or they may be located to one side of the transfer plate so that the cans may pass by them.

Unlike the case for containers situated on a moving conveyor belt or chain, it is not easily possible to measure the coefficient of friction between a moving container and a stationary plate because there is no available method to measure the force between the finger of the drive chain and the container which acts to move the container against the friction between the container and plate. For transport on stationary plates, effective lubrication is observed as the absence of chattering, wobbling and spinning of the container. The effectiveness of lubrication can also be gauged through the amount of beverage spilling. A convenient and readily accessible value for amount of beverage spilled is the proportion of closed containers that are rejected from the conveyor line downstream from the closing device using a fill height detector device.

For effective transfer plate operation, it is believed that sufficient liquid lubricant coverage depth is required so as to allow the filled unclosed containers to "hydroplane" or skim over the surface of the liquid lubricant layer so that actual contact between the container and stationary plate is substantially prevented. Consequently, effective transfer plate lubrication may be considered to be hydrodynamic lubrication. Purely hydrodynamic lubrication is dependent upon the presence of a liquid (hydro-), relative motion (-dynamic), viscous properties of the liquid, and the geometry of the surfaces between sliding surfaces in which a convergent wedge of fluid is produced. Because the geometry of the container bottom may be significantly departed from flat or planar, it is not always possible to maintain a convergent wedge of fluid between containers and the plate. As a result, containers may not always remain completely physically separated from the transfer plate. Slight rocking or vibration of containers is expected to propel relatively non-planar geometrical features on the bottom of containers into direct contact with the stationary plate, increasing vibration and rocking, which further increases contact in a self-reinforcing spiral.

The presence of surface active compounds in the lubricant layer on stationary container transfer plates can improve transfer, minimizing rocking, chattering, spillage and incidence of machine jamming. While not wishing to be bound by theory, it is believed that the role of surface active compounds in stationary plate lubrication is to minimize interaction between the container and the plate in the situation of failure of the convergent hydrodynamic fluid layer and contact.

Because a large volume flow of liquid is required to maintain the flooded condition of the plate, high concentrations of lubricant compounds have been required, generally exceeding about 1500 ppm of lubricant such as Klenz Glide 20 (an oleic acid lubricant commercially available from Ecolab Inc.) or Lubodrive RX (a surfactant lubricant commercially available from Ecolab Inc.). The combination of large volume flow and high lubricant concentration results in excessive waste, cost and environmental impact. Furthermore, the effectiveness of the lubricant compounds may be reduced via inactivation caused by water hardness or spilled beverage. In the case of inactivation due to water hardness, it may be required to soften water used for preparation of lubricant working solution, to use environmentally unfriendly sequestrants, or both. Often the only solution to inactivation caused by interaction with spilled beverage is to increase the concentration of surface active compounds to allow for some sacrificial loss, which means more lubricant and further worsening waste and environmental impact.

Compositions

The present disclosure is generally directed to a method of lubricating a stationary transfer plate using a substantially aqueous lubricant composition that comprises suspended or emulsified oil. By oil it is meant a water immiscible compound or mixture of compounds that are insoluble in water at 25° C. and when mixed with water give either a second, separated liquid phase or form dispersoids (colloidal bodies of a second immiscible phase) which cause the composition to exhibit a Tyndall effect, translucency or opacity. Oil can also include a material that is substantially immiscible or insoluble in water, providing less than about 1000 ppm of solubility.

The disclosed compositions provide a lubricant film or puddle comprising suspended fine sub-micron sized dispersoids of oil that reduces the coefficient of friction between the containers and the stationary transfer plate, minimizing chattering, spinning, and product spillage. The lubricant composition may preferably be applied to the stationary transfer plate by spraying or it can be applied as a continuous stream, as for example by pumping upwardly through vertically situated orifices onto the top container-contacting surface of the stationary plate (e.g., as shown in FIG. 1).

The oil may be natural or synthetic. By natural it is meant that the water insoluble oil compound is extracted, purified or derived from a natural source without chemical alteration or reaction or the making or breaking of covalent bonds.

In some embodiments, the oil is a water-insoluble oil that may be incorporated into the lubricant as an emulsion. Therefore, in some embodiments, the disclosed compositions include an optional emulsifier. The disclosed compositions can also include other additional functional materials.

The disclosed compositions may be provided as a concentrate or as a ready-to-use product. The concentrate refers to a product that is diluted to form the ready-to-use product. The ready-to-use product refers to the product that is applied to the transfer plate. Because the lubricant composition that is applied to the transfer plate is mostly water, it may be beneficial to provide the lubricant composition as a concentrate that is diluted before being applied to the transfer plate.

Oil

The disclosed compositions include an oil. Exemplary oils (also referred to as a lubricant) may be silicone-based or lipophilic-based. Useful oils may be mixtures of two or more discrete compounds. Preferred oils, whether as a single compound or as a mixture of compounds, are liquids at temperatures above 0° C.

Silicone-based lubricants. Exemplary silicone-based lubricants are silicone emulsions. Suitable silicone emulsions made using preferred emulsifiers include E2175 high viscosity polydimethylsiloxane (a 60% siloxane emulsion commercially available from Lambent Technologies, Inc.), E2140 polydimethylsiloxane (a 35% siloxane emulsion commercially available from Lambent Technologies, Inc.), E2140 FG food grade intermediate viscosity polydimethylsiloxane (a 35% siloxane emulsion commercially available from Lambent Technologies, Inc.), Dow Corning HV600 Emulsion (a nonionic 55% trimethylsilyl terminated polydimethylsiloxane dispersion available from Dow Corning), Dow Corning 1664 Emulsion (a nonionic 50% trimethylsilyl terminated polydimethylsiloxane dispersion available from Dow Corning), Dow Corning 1101 (an anionic, 50% active emulsion based on silanol terminated high viscosity polydimethylsiloxane available from Dow Corning), Dow Corning 346 (a nonionic, 60% active trimethylsilyl terminated polydimethylsiloxanes emulsion available from Dow Corning, Midland Mich.), GE SM 2068A (an anionic 35% silanol terminated polydimethylsiloxane dispersion available from General Electric Silicones, Wilton N.Y.), GE SM 2128 (a nonionic 35% trimethylsilyl terminated polydimethylsiloxane dispersion available from General Electric Silicones), GE SM 2135 (a nonionic 50% trimethylsilyl terminated polydimethylsiloxane dispersion available from General Electric Silicones), GE SM 2138 (a nonionic 60% silanol terminated polydimethylsiloxane dispersion available from General Electric Silicones), GE SM 2140 (a nonionic 50% trimethylsilyl terminated polydimethylsiloxanes dispersion available from General Electric Silicones), GE SM 2154 (a nonionic 50% methylhexylisopropylbenzyl siloxane dispersion available from General Electric Silicones), GE SM 2162 (a nonionic 50% trimethylsilyl terminated polydimethylsiloxane dispersion available from General Electric Silicones), GE SM 2163 (a nonionic 60% trimethylsilyl terminated polydimethylsiloxane dispersion available from General Electric Silicones), GE SM 2167 (a cationic 50% trimethylsilyl terminated polydimethylsiloxane dispersion available from General Electric Silicones), GE SM 2169 (a nonionic 60% trimethylsilyl terminated polydimethylsiloxanes dispersion available from General Electric Silicones), GE SM 2725 (an anionic 50% silanol terminated polydimethylsiloxane dispersion available from General Electric Silicones), KM 901 (a nonionic 50% trimethylsilyl terminated polydimethylsiloxanes dispersion available from Shin-Etsu Silicones of America, Inc. Akron, Ohio), Fluid Emulsion Eli) (a nonionic 38% silicone emulsion available from Wacker silicones, Adrian, Mich.), Fluid Emulsion E1044 (a nonionic 39% silicone emulsion available from Wacker silicones, Adrian, Mich.), KM 902 (a nonionic 50% trimethylsilyl terminated polydimethylsiloxane dispersion available from Shin-Etsu Silicones of America, Inc. Akron, Ohio), and equivalent products. Preferred silicone emulsions typically contain from about 30 wt. % to about 70 wt. % water.

Non-water-miscible silicone materials (e.g., non-water-soluble silicone fluids and non-water-dispersible silicone powders) can also be employed in the lubricant if combined with a suitable emulsifier (e.g., nonionic, anionic or cationic emulsifiers). Care should be taken to avoid the use of emulsifiers or other surfactants that promote environmental stress cracking in plastic containers.

Polydimethylsiloxane emulsions are preferred silicone materials.

Lipophilic-based lubricants. The oil or lubricant may be a lipophilic compound. The lipophilic compound may be described by its chemical structure. For example, suitable lipophilic compounds include but are not limited to (1) a water insoluble organic compound including two or more ester linkages; (2) a water insoluble organic compound including three or more oxygen atoms; (3) a water insoluble organic compound including three or more oxygen atoms, one ester group (which can include two of these oxygen atoms) and one or more remaining or free hydroxyl groups; (4) an ester of a long chain carboxylic acid (e.g., a fatty acid) with a short chain (i.e., 5 or fewer carbon atoms) alcohol (e.g., methanol); (5) an ester including a di-, tri-, or polyhydric alcohol, such as glycerol, with 2 or more of the hydroxyl groups each being coupled to a carboxylic acid as an ester group; and mixtures thereof.

The lipophilic compounds may also be described by their chemical components. For example, suitable lipophilic compounds include esters of monocarboxylic fatty acids and di- and poly-carboxylic acid compounds. Suitable fatty acid components of the ester include octanoic acid, nonanoic acid, decanoic acid, undecanoic acid, dodecanoic acid, palmitic acid, stearic acid, oleic acid, or mixture thereof. Suitable di- and poly carboxylic acid components of the ester include adipic acid, succinic acid, glutaric acid, sebacic acid, phthalic acid, trimellitic acid, and mixtures thereof. In esters with di-, tri-, or poly-hydric alcohols suitable carboxylic acid components include those listed above and also, for example, monocarboxylic acid components such as butanoic acid, hexanoic acid, heptanoic acid, or mixtures thereof.

The esters can include any of a variety of alcohol moieties, such as monohydric fatty alcohols and di- and polyhydric compounds. Suitable monohydric alcohol components of the ester include primary aliphatic alcohols, such as aliphatic hydrocarbon alcohols, for example, methanol, ethanol, and linear and branched primary alcohols with 3 to 25 carbon atoms. Suitable di- and poly-hydric alcohol components of the ester include those containing from 2 to about 8 hydroxy groups such as alkylene glycols, e.g., ethylene glycol, diethylene glycol, neopentyl glycol, tetraethylene glycol, or mixtures thereof. Additional suitable alcohol components of the ester include glycerine, erythritol, mannitol, sorbitol, glucose, trimethylolpropane (TMP), pentaerythritol, dipentaerythritol, sorbitan, or mixtures thereof.

The ester can include any of a variety of carboxylic acid and alcohol residues that provide a water insoluble (not capable to be dissolved in water to give clear solutions at concentrations greater than about 0.1% by weight at room temperature) ester that is a liquid, semi-solid, or a low melting solid. In the disclosed lubricant compositions, the lipophilic compound can be the dispersed phase in a colloidal dispersion.

Suitable lipophilic compounds also include triglycerides, partial glycerides, phospholipids, cardiolipids, and the like.

Triglycerides have the general formula:

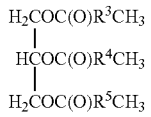

in which $R^3$, $R^4$, and $R^5$ are independently linear or branched, saturated and/or unsaturated, optionally hydroxy- and/or epoxy-substituted residues with 6 to 22, or 12 to 18 carbon atoms.

The triglycerides can be of natural origin or produced synthetically. In an embodiment, the triglyceride has linear and saturated alkylene residues with chain length between 6 and 22 carbon atoms. They are optionally hydroxy- and/or epoxy-functionalized substances, such as castor oil or hydrogenated castor oil, epoxidized castor oil, ring-opening products of epoxidized castor oils of varying epoxy values with water and addition products of on average 1 to 100 mol, 20 to 80 mol, or even 40 to 60 mol to these cited triglycerides.

Suitable triglycerides include those sold under the trade names Myritol 331, Myritol 312, Myritol 318, Terradrill V988, the Terradrill EM, which are commercially available from Cognis; and Miglyol 812 N and Miglyol 812, which are commercially available from Sasol.

Partial glycerides are monoglycerides, diglycerides and blends thereof, which may also contain small quantities of triglyceride. Suitable partial glycerides can have the general formula:

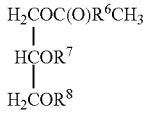

in which $R^6$, $R^7$ and $R^8$ independently represent a linear or branched, saturated and/or unsaturated residue with 6 to 22, for example, 12 to 18 carbon atoms or H with the proviso that at least one of the two residues $R^7$ and $R^8$ is H.

Suitable monoglycerides, diglycerides, or triglycerides include esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselinic acid, linoleic acid, linolenic acid, eleostearic acid, arachic acid, gadoleic acid, behenic acid, erucic acid, or mixtures thereof. Suitable glycerides include lauric acid glycerides, palmitic acid glycerides, stearic acid glycerides, isostearic acid glycerides, oleic acid glycerides, behenic acid glycerides, erucic acid glycerides, or mixtures thereof and include those displaying a monoglyceride content from about 50 to about 95 wt-%, or about 60 to about 90 wt-%.

Suitable phospholipids include, for example, phosphatidic acids, real lecithins, cardiolipins, lysophospholipids, lysolecithins, plasmalogens, phosphosphingolipids, sphingomyelins. Suitable phospholipids include phosphatidylcholine, phosphatidylethanolamine, phosphatidylinositol, or N-acylphosphatidylethanolamine, or mixture thereof. Suitable phospholipids include lecithins. Types of lecithin include crude lecithins which have been deoiled, fractionated, spray-dried, acetylated, hydrolyzed, hydroxylated, or hydrogenated. They are available commercially. Suitable lecithins include soybean lecithins. As used herein, the general term "lecithin" includes phospholipids.

Phosphatidic acids are glycerol derivatives which have been esterified in the 1-sn- and 2-position with fatty acids (1-sn-position: mostly saturated, 2-position: mostly mono- or polyunsaturated), or on atom 3-sn with phosphoric acid. The phosphate radical can be esterified with an amino alcohol, such as choline (lecithin=3-sn-phophatidylcholine), 2-aminoethanol (ethanolamine), L-serine (cephalin=3-sn-phosphatidylethanolamine or sn-phosphatidyl-L-serine), with myoinositol to give the phosphoinositides [1-(3-sn-phosphatidyl)-D-myoinositols], with glycerol to give phosphatidyl glycerols.

Cardiolipins (1,3-bisphosphatidyl glycerols) are phospholipids of two phosphatidic acids linked via glycerol. Lysophospholipids are obtained when an acyl radical is cleaved off by a phospholipase A from phospholipids (e.g. lysolecithins). The phospholipids also include plasmalogens in which an aldehyde (in the form of an enol ether) is bonded in the 1-position instead of a fatty acid. Phosphosphingolipids are based on the basic structure of sphingosine or else phytosphingosine.

Suitable phospholides for use in the present compositions include those sold under the trade names Lipoid S 20 S, Lipoid S 75, Lipoid S 100, Lipoid S 100-3, Lipoid S 75-3N, Lipoid SL 80, and Lipoid SL 80-3, which are commercially available from Lipoid; Phospholipon 85 G, Phospholipon 80, Phospholipon 80 H, Phospholipon 90 G, Phospholipon 90 H, Phospholipon 90 NG, Phospholipon 100 H, Phosal 35B, Phosal 50G, Phosal 50SA, Phosal 53MCT, and Phosal 75SA, which are commercially available from Phospholipon, Cologne Germany; Alcolec Z-3 available from American Lecthin Company, Oxford Conn.; Emulfluid F30, Emulfluid, Lipotin NE, Lipotin 100, Lipotin SB, Lipotin 100J, Lipotin H, Lipotin NA, Lipotin AH, and Lipopur, which are commercially available from Cargill (Degussa Texturant Systems); Terradrill V 408 and Terradrill V 1075, which are commercially available from Cognis; Yellowthin 100, Yellowthin 200, Lecistar Sun 100, and Yellowthin Sun 200, which are commercially available from Sternchemie; and Lanchem PE-130K available from Lambent Technologies, Gurnee, Ill.

Suitable lipophilic compounds also include the following: a partial fatty acid ester of glycerine; a partial or higher fatty acid ester of sorbitan; a fatty acid diester of a glycol or a poly(alkylene glycol) compound; a fatty acid ester of a polyol such as sucrose, pentaerythritol or dipentaerythritol; a methyl ester of a fatty acid; a fatty alcohol ester of benzoic acid; a fatty alcohol ester of phthalic acid or isophthalic acid; lanolin or a lanolin derivative; a fatty acid ester of trimethylol propane; or a mixture thereof.

Suitable partial esters of glycerine with linear or branched long chain (greater than about 8 carbon atoms) fatty acids include glycerol monooleate, glycerol monoricinoleate, glycerol monostearate, and glycerol monotallate (e.g. Lumulse GMO-K, Lumulse GMR-K, Lumulse GMS-K, and Lumulse GMT-K, available from Lambent Technologies, Gurnee IL and Tegin OV, available from Goldschmidt Chemical Corporation, Hopewell, Va.), or a mixture thereof. Suitable partial glycerides also include those sold under the tradenames Cutina EGMS, Cutina GMS-SE, Cutina GMS V, Cutina MD, or Cutina AGS, which are commercially available from Cognis.

Suitable partial and higher sorbitan esters, include for example, di- or tri-esters with linear or branched long chain (greater than about 8 carbon atoms) fatty acids, such as such as sorbitan tristearate, and sorbitan triooleate, and sorbitan sesquioleate (e.g., Lumisorb STS K, available from Lambent Technologies, Gurnee Ill., and Liposorb TO and Liposorb SQO, available from Lipo Chemicals, Paterson N.J.), or a mixture of these compounds.

Suitable diesters of glycol or poly(alkylene glycol) compounds with linear or branched long chain (greater than about 8 carbon atoms) fatty acids include neopentyl glycol dicaprylate/dicaprate and PEG-4 diheptanoate (e.g. Liponate NPCG-2 and Liponate 2-DH, available from Lipo Chemicals, Paterson N.J.).

Suitable fatty acid esters of polyols include polyol fatty acid polyesters, which term refers to a polyol that has two or more of its hydroxyl groups esterified with linear or branched long chain (greater than about 8 carbon atoms) fatty acid groups. For example, the polyol can be esterified with four or more fatty acid groups. Suitable polyol fatty acid polyesters include sucrose polyesters having on average at least four or five ester linkages per molecule of sucrose; the fatty acid chains can have from about eight to about twenty-four carbon atoms. Other suitable polyol fatty acid polyesters are esterified linked alkoxylated glycerins, including those including polyether glycol linking segments and those including polycarboxylate linking segments. Suitable polyols include aliphatic or aromatic compounds containing at least two free hydroxyl groups, and can include backbones such as saturated and unsaturated straight and branch chain linear aliphatics; saturated and unsaturated cyclic aliphatics, including heterocyclic aliphatics; or mononuclear or polynuclear aromatics, including heterocyclic aromatics. Polyols include carbohydrates and non-toxic glycols. Suitable fatty acid esters of sucrose include the soyate fatty acid ester of sucrose and the stearate fatty acid ester of sucrose (e.g. Sefose 1618S and Sefose 1618H, available from Proctor and Gamble Chemicals, Cincinnati Ohio). Suitable fatty acid esters of pentaerythritol and dipentaerythritol include pentaerythrityl tetracaprylate/tetracaprate and dipentaerythrityl hexacaprylate/hexacaprate (e.g. Liponate PE-810 and Liponate DPC-6 available from Lipo Chemicals, Paterson N.J.).

Suitable methyl esters of fatty acids include methyl palmitate and methyl stearate (e.g. CE-1695 and CE-1897, available from Proctor and Gamble Chemicals, Cincinnati Ohio).

Suitable fatty alcohol esters of benzoic acid include C12-C15 alkyl benzoate (e.g. Liponate NEB, available from Lipo Chemicals, Paterson N.J.).

Suitable fatty alcohol esters of phthalic acid or isophthalic acid include dioctyl phthalate.

Suitable fatty alcohol esters of trimellitic acid include tridecyl trimellitate (e.g. Liponate TD™, available from Lipo Chemicals, Paterson N.J.).

Suitable lanolins and lanolin derivatives include hydrogenated lanolin and lanolin alcohol (e.g Technical Grade Lanolin, Ritawax, and Supersat available from Rita Corporation, Crystal Lake Ill.).

Suitable fatty acid esters of trimethylol propane include trimethylol propane trioleate and trimethylol propane tricaprate/caprylate (e.g. Synative ES 2964 available from Cognis and Priolube 3970 available from Uniqema New Castle, Del.).

In an embodiment, the lipophilic compound is or includes mineral oil.

In an embodiment, the lipophilic compound is or includes a long chain (greater than about 8 carbon atoms) fatty acid compound including a fatty acid derived from the saponification of vegetable or animal fat or an oil such as tall oil fatty acid, coconut fatty acid, oleic acid, ricinoleic acid, or carboxylic acid terminated short chain polymers of hydroxyl functional fatty acids such as ricinoleic acid and salts thereof (e.g. Hostagliss L4 available from Clariant Corporation, Mount Holly N.J.), or a mixture of these compounds. Suitable fatty acid lipophilic compounds include caproic acid, lauric acid, myristic acid, oleic acid, stearic acid (e.g. C-698, C-1299, C-1495, OL-800 and V-1890, available from Proctor and Gamble Chemicals, Cincinnati Ohio), or a mixture thereof.

Exemplified lipophilic compounds include tri(caprate/caprylate) ester of glycerine; caprylate, caprate, cocoate triglyceride; soyate fatty acid ester of sucrose; diheptanoate ester of poly(ethylene glycol); and trimethylol propane trioleate.

Other Exemplary Oils.

Synthetic Ester Oil. The oil may be a synthetic ester oil. Suitable synthetic ester oils include esters of monocarboxylic fatty acids and mono-, di- and poly-hydric alcohol compounds. Suitable monocarboxylic fatty acid components of the ester include benzoic acid, octanoic acid, nonanoic acid, decanoic acid, undecanoic acid, dodecanoic acid, myristic acid, palmitic acid, stearic acid, oleic acid, behenic acid, or mixture thereof. The esters can include any of a variety of alcohol moieties, such as monohydric fatty alcohols and di- and polyhydric compounds. Suitable monohydric alcohol components of the ester include primary aliphatic alcohols, such as aliphatic hydrocarbon alcohols, for example, methanol, ethanol, and linear and branched primary alcohols with 3 to 25 carbon atoms. Suitable di- and poly-hydric alcohol components of the ester include those containing from 2 to about 8 hydroxy groups such as alkylene glycols, e.g., ethylene glycol, diethylene glycol, neopentyl glycol, tetraethylene glycol, or mixture thereof. Additional suitable alcohol components of the ester include glycerine, erythritol, mannitol, sorbitol, glucose, sucrose, trimethylolpropane (TMP), pentaerythritol, dipentaerythritol, sorbitan, or mixture thereof.

Suitable synthetic ester oils include esters of di- and poly carboxylic acids and monohydric alcohol compounds. Suitable di- and poly carboxylic acid components of the ester include adipic acid, succinic acid, glutaric acid, sebacic acid, phthalic acid, isophthalic acid, trimellitic acid, and mixtures thereof. Suitable monohydric alcohol components of the ester include primary aliphatic alcohols, such as aliphatic hydrocarbon alcohols, for example, methanol, ethanol, and linear and branched primary alcohols with 3 to 25 carbon atoms.

Synthetic ester oils can include any of a variety of carboxylic acid and alcohol residues that provide a water insoluble (not capable to be dissolved in water to give clear solutions at concentrations greater than about 0.1% by weight at room temperature) ester that is a liquid, semi-solid, or a low melting solid. Preferred synthetic ester oils include synthetically produced triglyceride compounds and triesters of trimethylol propane such as trimethylol propane tricocoate, trimethylol propane tri(caprate/caprylate), and glycerine tri(caprate/caprylate).

Free Fatty Acid. The oil may be a free fatty acid. Suitable free fatty acids include octanoic acid, nonanoic acid, decanoic acid, undecanoic acid, dodecanoic acid, myristic acid, palmitic acid, stearic acid, oleic acid, behenic acid, or mixture thereof.

Hydrocarbon. The oil may include a synthetic or natural hydrocarbon compound. Suitable synthetic hydrocarbons include polybutenes such as Indopol™ (Ineos Oligomers, League City Tex.), hydrogenated polybutenes such as Panalane™ (Ineos Oligomers), poly(alpha olefins) such as SpectraSyn™ products (ExxonMobil Chemical, Houston Tex.), and synthetic isoparaffinic fluids such as Isopar™ (ExxonMobil Chemical).

The disclosed ready-to-use compositions may contain between about 0.0001 wt. % to about 0.15 wt. %, about 0.005 wt. % to about 0.15 wt. %, about 0.001 wt. % to about 0.10 wt. %, about 0.001 wt. % to about 0.05 wt. % of oil, about 0.0001 to about 0.001 wt. % of oil, or about 0.0005 wt. % to about 0.001 wt. %. The disclosed concentrate compositions may contain between about 0.1 wt. % to about 50 wt. %, about 0.5 wt. % to about 20 wt. %, or about 0.5 wt. % to about 5 wt. % of oil. The amount of lubricating oil that is applied to the transfer plate is preferably between about 1 and about 250 g hour, between about 1 and about 100 mg/hour, or between about 1 and about 20 mg/hour.

Emulsifiers

The disclosed compositions may optionally include an emulsifier to help solubilize the oil. Exemplary emulsifiers include nonionic surfactants such as:

(1) mono- and di-esters of glycerine with linear or branched long chain (greater than about 8 carbon atoms) fatty acids, such as glycerol monooleate, glycerol monoricinoleate, glycerol monostearate, and glycerol monotallate (e.g. Lumulse GMO-K, Lumulse GMR-K, Lumulse GMS-K, and Lumulse GMT-K, available from Lambent Technologies, Gurnee Ill. and Tegin OV, available from Goldschmidt Chemical Corporation, Hopewell, Va.), or a mixture of these surfactants;

(2) polyglyceryl monoesters with linear or branched long chain (greater than about 8 carbon atoms) fatty acids such as triglycerol monooleate (e.g. Lumulse PGO-K, available from Lambent Technologies, Gurnee Ill.), or a mixture of these surfactants;

(3) ethoxylated mono- and di-esters of glycerine with linear or branched long chain (greater than about 8 carbon atoms) fatty acids such as poly(oxyethylene) glyceryl monolaurate (e.g. Lumulse POE (7) GML and Lumulse POE (20) GMS-K, available from Lambent Technologies, Gurnee Ill.), or a mixture of these surfactants;

(4) sorbitan esters with linear or branched long chain (greater than about 8 carbon atoms) fatty acids such as sorbitan monolaurate, sorbitan monopalmitate, sorbitan monostearate, and sorbitan monooleate (e.g., SPAN series 20, 40, 60, and 80, available from Uniqema, New Castle, Del. and Lumisorb SMO, available from Lambent Technologies, Gurnee Ill.), or a mixture of these surfactants;

(5) ethoxylated sorbitan esters with linear or branched long chain (greater than about 8 carbon atoms) fatty acids such as polyoxyethylene (20) sorbitan monolaurate (polysorbate 20), polyoxyethylene (20) sorbitan monopalmitate (polysorbate 40), polyoxyethylene (20) sorbitan monostearate (polysorbate 60), and polyoxyethylene (20) sorbitan monooleate (polysorbate 80) (e.g., TWEEN series 20, 40, 60, and 80, available from Uniqema, New Castle, Del.), or a mixture of these surfactants;

(6) ethoxylated castor oils such as PEG-5 castor oil, PEG-25 castor oil, and PEG-40 castor oil (e.g. Lumulse CO-5, Lumulse CO-25, and Lumulse CO-40 available from Lambent Technologies, Gurnee Ill.), or a mixture of these surfactants;

(7) mono- and di-esters of ethylene glycol and poly (ethylene glycol) with linear or branched long chain (greater than about 8 carbon atoms) fatty acids such as ethylene glycol distearate, PEG-400 monooleate, PEG-400 monolaurate, PEG-400 dilaurate, and PEG-4 diheptanoate (e.g. Lipo EGDS available from Lipo Chemicals, Paterson N.J., Lumulse 40-OK, Lumulse 40-L, and Lumulse 42-L available from Lambent Technologies, Gurnee Ill. and LIPONATE 2-DH, product of Lipo Chemicals, Inc., Paterson N.J.), or a mixture of these surfactants;

(8) EO-PO block copolymers such as poly(ethylene oxide)-poly(propylene oxide)-poly(ethylene oxide) block copolymers and poly(propylene oxide)-poly(ethylene oxide)-poly(propylene oxide) block copolymers (e.g. Pluronic and Pluronic R series products available from BASF Corporation, Florham Park N.J.), or a mixture of these surfactants;

(9) alcohol ethoxylates, alcohol propoxylates, and alcohol ethoxylate propoxylates formed from the addition of ethylene oxide and/or propylene oxide to linear or branched long chain (C8 or greater) fatty alcohols such as poly(ethylene oxide) undecyl ether, poly(ethylene oxide) ether with (C12-C15) linear primary alcohols, poly(ethylene oxide) ether with (C14-C15) linear primary alcohols, and ethoxylated propoxylated C8-10 alcohols (e.g. Tomadol 1-3 alcohol ethoxylate, Tomadol 25-7 alcohol ethoxylate, and Tomadol 45-7 alcohol ethoxylate available from Air Products, Inc., Allentown Pa.; and Antarox BL-214 available from Rhodia, Cranbury N.J.), or a mixture of these surfactants;

(10) alcohol ethoxylates formed from the addition of ethylene oxide to linear and branched alkylphenol compounds such as poly(ethylene oxide) ether with nonyl phenol (e.g. Surfonic N95, available from Huntsman Chemical Corporation, The Woodlands Tex.), or a mixture of these surfactants;

(11) alkylated mono-, di- and oligoglycosides containing 8 to 22 carbon atoms in the alkyl group and ethoxylated alkylated mono-, di- and oligoglycosides containing 8 to 22 carbon atoms in the alkyl group such as poly(D-glucopyranose) ether with (C8-C14) linear primary alcohols (e.g. Glucopon 425N/HH, available from Cognis North America, Cincinnati Ohio), or a mixture of these surfactants;

(12) amide compounds formed from linear or branched long chain (greater than about 8 carbon atoms) fatty acids such as coconut acid diethanolamide and oleic acid diethanolamide (e.g. Ninol 40-CO and Ninol 201, available from Stepan Corporation, Northfield Ill. and Hostacor D T, available from Clariant Corporation, Mount Holly, N.C.), or a mixture of these surfactants;

(13) ethoxylate compounds formed from the addition of ethylene oxide to amide compounds formed from linear or branched long chain (greater than about 8 carbon atoms) fatty acids such as poly(ethylene oxide) ether with coconut acid ethanolamide (e.g. Ninol C-5 available from Stepan Corporation, Northfield Ill.), or a mixture of these surfactants;

(14) nonionic silicone surfactants such as poly(ethylene oxide) ether with methyl bis(trimethylsilyloxy) silyl propanol (e.g. Silwet L77 available from Momentive Performance Materials, Wilton N.J.), or a mixture of these surfactants;

(15) trialkyl phosphates, or a mixture of trialkyl phosphates;

(16) mono- and di-esters of glycerine with linear or branched long chain (greater than about 8 carbon atoms) fatty acids further esterified with short chain monocarboxylic acids, such as such as glycerol monostearate lactate (e.g. Grindsted Lactem P22, available from Danisco, Copenhagen Denmark), or a mixture of these surfactants; or

(17) a mixture of such surfactants.

Exemplary emulsifiers include lecithin, ethoxysorbitan monostearate, glycerol monooleate, and 20 mole ethoxylated castor oil.

The disclosed compositions may include a combination of emulsifiers, including emulsifiers with different HLB values.

Over time, emulsions tend to revert to the stable state of oil separated from water, a process which is retarded by emulsifiers. It is understood that in the context of the present disclosure that "stable emulsion" does not refer only to systems that are thermodynamically stable, but also includes systems in which the kinetics of decomposition have been greatly slowed, that is, metastable systems. In certain embodiments, the disclosed emulsions do not physically phase separate, exhibit creaming or coalescence, or form precipitate. In an embodiment, the emulsion is sufficiently stable that it is stable under conditions at which the disclosed lubricant composition is stored and shipped. For example, in an embodiment, the present stable emulsion does not phase separate in one month at 4 to 50° C., or even in two months or three months at such temperatures.

The disclosed ready-to-use compositions may contain between about 0.0001 wt. % to about 0.05 wt. %, about 0.0001 wt. % to about 0.02 wt. %, or about 0.0005 wt. % to about 0.05 wt. % of emulsifier. The disclosed concentrate compositions may contain between about 0.1 wt. % to about 10 wt. %, about 0.1 wt. % to about 4 wt. %, or about 0.1 wt. % to about 1 wt. % of emulsifier.

In some embodiments, the concentration of oil and emulsifier in the ready-to-use composition is less than 5000 ppm, less than 2000 ppm, less than 1500 ppm, less than 1000 ppm, or less than 500 ppm.

Additional Components

The disclosed compositions may optionally include additional components if desired. For example, the compositions can contain adjuvants such as a hydrophilic diluent, an antimicrobial agent, a stabilizing or coupling agent, a surfactant, a corrosion inhibitor, a chelant, a pH buffering agent, and water soluble lubricants.

Hydrophilic Diluent

Exemplary hydrophilic diluents include water, alcohols such as isopropyl alcohol, polyols such as ethylene glycol and glycerine, ketones such as methyl ethyl ketone, and cyclic ethers such as tetrahydrofuran. When present, the hydrophilic diluent may make up the majority of the composition that is applied to the transfer plate.

Antimicrobial Agents

The disclosed compositions may optionally include an antimicrobial agent. Exemplary antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether; organic and inorganic acids and corresponding esters and salts such as dehydroacetic acid, peroxycarboxylic acids, peroxyacetic acid, peroxyoctanoic acid, methyl p-hydroxy benzoic acid; cationic agents such as quaternary ammonium compounds; amine or amine salts such as oleyl diamino propane diacetate, coco diamino propane diacetate, lauryl propyl diamine diacetate, dimethyl lauryl ammonium acetate; isothiazolinone compounds such as 2-methyl-4-isothiazolin-3-one and 5-chloro-2-methyl-4-isothiazolin-3-one; phosphonium compounds such as tetrakishydroxymethyl phosphonium sulphate (THPS), aldehydes such as glutaraldehyde, antimicrobial dyes such as acridines, triphenylmethane dyes and quinines; and halogens including iodine and chlorine compounds. The antimicrobial agents can be used in amounts to provide the desired antimicrobial properties.

Stabilizing/Coupling Agents

The disclosed compositions may optionally include stabilizing agents or coupling agents to keep the composition homogeneous. Exemplary stabilizing or coupling agents include isopropyl alcohol, ethanol, urea, octane sulfonate, and glycols such as hexylene glycol, propylene glycol and the like.

Detergents/Dispersing Agents

The disclosed composition may optionally include detergents or dispersing agents. Some examples of detergents and dispersants include alkyl benzene sulfonic acid, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include alkoxylated fatty alkyl monoamines and diamines such as coco bis (2-hydroxyethyl)amine, polyoxyethylene (5)-coco amine, polyoxyethylene(15)coco amine, tallow bis(-2hydroxyethyl)amine, polyoxyethylene(15)amine, polyoxyethylene(5)oleyl amine and the like.

Corrosion Inhibitors

The disclosed compositions may optionally include a corrosion inhibitor. Exemplary corrosion inhibitors include polycarboxylic acids such as short chain carboxylic diacids, triacids, as well as phosphate esters and combinations thereof. Useful phosphate esters include alkyl phosphate esters, monoalkyl aryl phosphate esters, dialkyl aryl phosphate esters, trialkyl aryl phosphate esters, and mixtures thereof such as Emphos PS 236 commercially available from Witco Chemical Company. Other useful corrosion inhibitors include the triazoles, such as benzotriazole, tolyltriazole and mercaptobenzothiazole, and in combinations with phosphonates such as 1-hydroxyethylidene-1, 1-diphosphonic acid, and surfactants such as oleic acid diethanolamide and sodium cocoamphohydroxy propyl sulfonate, and the like. Useful corrosion inhibitors include polycarboxylic acids such as dicarboxylic acids. The acids which are preferred include adipic, glutaric, succinic, and mixtures thereof.

Chelants

The disclosed compositions may optionally include a chelating agent or sequestrant. Exemplary sequestrants include ethylene diamine tetracetic acid (EDTA), iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Water Soluble Lubricants

The disclosed compositions may optionally include a water-miscible or water soluble lubricant. Exemplary water soluble lubricants include hydroxy-containing compounds such as polyols (e.g., glycerol and propylene glycol); polyalkylene glycols (e.g., Carbowax™ series of polyethylene and methoxypolyethylene glycols), linear copolymers of ethylene and propylene oxides (e.g., Ucon™ 50-HB-100 water-soluble ethylene oxide:propylene oxide copolymer) and sorbitan esters (e.g., the Tween™ series 20, 40, 60, 80, and 85 polyoxyethylene sorbitan monooleates and Span™ series 20, 80, 83 and 85 sorbitan esters). Other exemplary water-miscible lubricants include phosphate esters and amines and their derivatives. Derivatives such as partial esters or ethoxylates of the above lubricants can also be used. In some embodiments, the disclosed compositions are substantially free of a water-miscible lubricant.

Methods of Use

Can or container transfer applications involve flooding a transfer plate with a lubricant composition diluted in water. The transfer plate may be made out of an assortment of materials including stainless steel or ultra-high molecular weight polyethylene. The plate typically has holes in the bottom with nozzles or bubblers in communication with holes for dispensing the lubricant composition onto the plate. For transfer plate lubrication, bubblers are the most common method of applying lubricant to the transfer plate. It is understood, however, that spray nozzles may also spray lubricant onto the top and side of the transfer plate, either alone or in conjunction with the bubblers underneath the transfer plate.

As previously mentioned, lubrication of transfer plates is typically provided by maintaining the plate surface flooded with an aqueous lubricant composition. By flooded it is meant that the plate is substantially immersed by a puddle of aqueous lubricant composition with a coverage of about 0.05 to about 0.2 mL/cm$^2$ (about 0.5 to 2 mm depth). A transfer plate may have 1, 2, 3, 4, 5, or 6 bubblers. In order to flood the transfer plate, the each bubbler preferably dispenses from about 1 to about 10 gallons, from about 2 to about 8 gallons, or from about 6 to about 8 gallons of ready-to-use lubricant composition per hour. During operation, the nozzles may flood the plate continuously or discontinuously.

The disclosed lubricants can be used with a variety of containers that may be transferred across a stationary transfer plate, including beverage containers, food containers, household or commercial cleaning product containers, and containers for oils, antifreeze, or other industrial fluids. The containers may be made of a wide variety of materials including glass, plastic (e.g., polyolefins such as polyethylene and polypropylene; polystyrenes, polyesters such as PET and polyethylene naphthalate (PEN), polyamides, polycarbonates, and mixtures or copolymers thereof), metals (e.g. aluminum, tin or steel), paper (e.g., untreated, treated, waxed or coated papers), ceramics, and laminates or composites or two or more of these materials (e.g., laminates of PET, PEN or mixtures thereof with another plastic material). The containers can have a variety of sizes and forms, including cartons (e.g., waxed cartons or TETRAPAK™ boxes), cans, bottles, and the like.

Various modifications and alteration of this disclosure will be apparent to those skilled in the art without departing from the scope and spirit of the invention and are intended to be within the scope of the following claims.

We claim:

1. A method of lubricating a stationary transfer plate comprising: diluting a concentrated lubricant composition to form a dilute lubricant composition; applying the dilute lubricant composition to a stationary transfer plate to provide coverage of about 0.05 to about 0.2 $mL/cm^2$ of dilute lubricant composition, the concentrated lubricant composition comprising:

an oil;

an emulsifier;

a water-miscible lubricant;

an antimicrobial agent; and water; and transporting a filled, unclosed container across the stationary transfer plate with a forward translational velocity of greater than 40 feet per minute.

2. The method of claim 1, wherein the dilute lubricant composition is applied from at least one nozzle or bubbler under the transfer plate at a rate of about 2 to 10 gallons of dilute lubricant composition per hour per nozzle or bubbler.

3. The method of claim 1, wherein the oil is selected from the group consisting of silicone oil, mineral oil, a fatty acid having more than 8 carbon atoms, trimethylol propane, trioleate, a triglyceride, and derivatives thereof.

4. The method of claim 1, wherein the oil is a silicone oil.

5. The method of claim 4, wherein the silicone oil comprises polydimethylsiloxane.

6. The method of claim 1, wherein the emulsifier is a nonionic surfactant.

7. The method of claim 1, wherein the concentrated lubricant composition comprises from about 0.5 wt. % to about 5 wt. % silicone oil.

8. The method of claim 1, wherein the dilute lubricant composition comprises from about 0.0005 wt. % to about 0.001 wt. % silicone oil.

9. The method of claim 1, wherein the antimicrobial agent is selected from the group consisting of a quaternary ammonium compound, an isothiazolone compound, a peroxycarboxylic acid, hydrogen peroxide, an amine, a halogen, and combinations thereof.

10. The method of claim 1, wherein the dilute lubricant composition is applied from up to 6 nozzles or bubblers.

11. The method of claim 1, wherein the dilute lubricant composition is applied at a rate of about 6 to about 8 gallons per hour per nozzle or bubbler.

12. The method of claim 1, wherein the dilute lubricant composition is applied continuously.

13. The method of claim 1, wherein the dilute lubricant composition is applied discontinuously.

14. The method of claim 1, further comprising transporting containers over the stationary transfer plate in a single file at a rate of up to 2200 cans per minute.

15. The method of claim 1, wherein the oil is applied to the transfer plate in an amount between about 1 and about 100 mg/hour.

16. The method of claim 1, wherein the water-miscible lubricant is selected from the group consisting of an amine, a phosphate ester, and derivatives thereof.

* * * * *